US007348521B2

(12) United States Patent
Lee et al.

(10) Patent No.: US 7,348,521 B2
(45) Date of Patent: Mar. 25, 2008

(54) ELECTRIC OVEN

(75) Inventors: Yong Woo Lee, Seoul (KR); Wan Soo Kim, Gwangnyung-si (KR); Yong Soo Lee, Sihoong-si (KR)

(73) Assignee: LG Electronics Inc., Seoul (KR)

( * ) Notice: Subject to any disclaimer, the term of this patent is extended or adjusted under 35 U.S.C. 154(b) by 12 days.

(21) Appl. No.: 11/412,785

(22) Filed: Apr. 28, 2006

(65) Prior Publication Data

US 2007/0131669 A1 Jun. 14, 2007

(30) Foreign Application Priority Data

Dec. 14, 2005 (KR) ..... 10-2005-0122816

(51) Int. Cl.

| | |
|---|---|
| ***H05B 3/08*** | (2006.01) |
| ***F21V 29/00*** | (2006.01) |
| ***H01K 1/58*** | (2006.01) |
| ***A21B 1/14*** | (2006.01) |
| ***A21B 1/22*** | (2006.01) |

(52) U.S. Cl. ..... 219/402; 219/405; 219/411; 219/541; 362/294

(58) Field of Classification Search ..... None
See application file for complete search history.

(56) References Cited

U.S. PATENT DOCUMENTS

| | | | | |
|---|---|---|---|---|
| 3,517,181 | A * | 6/1970 | Daley et al. | 362/373 |
| 5,219,221 | A * | 6/1993 | Yamaka et al. | 362/294 |
| 5,420,769 | A * | 5/1995 | Ahlgren et al. | 362/294 |
| 5,968,397 | A * | 10/1999 | Wyland et al. | 219/540 |
| 6,093,919 | A * | 7/2000 | Seo et al. | 219/685 |
| 6,417,494 | B1 * | 7/2002 | Westerberg et al. | 219/402 |
| 6,864,468 | B2 | 3/2005 | Kim et al. | |
| 2003/0173348 | A1 * | 9/2003 | Backer et al. | 219/405 |
| 2005/0133019 | A1 | 6/2005 | Kim et al. | |
| 2005/0211696 | A1 * | 9/2005 | Adamski | 219/400 |

FOREIGN PATENT DOCUMENTS

| | | |
|---|---|---|
| KR | 20-1989-0019709 | 9/1989 |

* cited by examiner

*Primary Examiner*—J. Pelham
(74) *Attorney, Agent, or Firm*—Greenblum & Bernstein, P.L.C.

(57) ABSTRACT

Provided is an electric oven. The electric oven includes a cavity having an electric component room, a light wave generating unit mounted on a top surface of the cavity, the light wave generating unit including a halogen heater emitting heat and light and a connector coupled to opposite ends of the halogen heater, and a heat discharge unit enclosing and cooling the connector.

16 Claims, 6 Drawing Sheets

ELECTRIC OVEN

BACKGROUND OF THE INVENTION

1. Field of the Invention

The present invention relates to an electric oven, and more particularly, to a heater cooling structure that can intensively cool only a seal portion of a halogen heater using the heat conduction.

2. Description of the Related Art

An electric oven is generally used for baking or roasting food by heating the food using heat and steam generated from the food and confined in the oven. Therefore, the food can be cooked with a good taste without being burnt or hardened by contraction, which caused when the food is directly roasted by fire.

A typical electric oven includes a cavity in which food is loaded and a door for opening and closing the oven to load and withdraw the food in and from the cavity. A heat source such as a heater is placed in the cavity.

The heater includes an upper infrared heater mounted on an upper portion of the cavity, a lower heater mounted on a lower portion of the cavity to increase an operation temperature of the cavity and a convection heater mounted on a rear portion of the cavity to bake the food. A fan is provided around the convection heater to circulate fluid in the cavity.

The electric oven heats the food by transferring thermal energy to the food by turning on one or more of the upper, lower and convection heaters or by alternately turning on them.

When the heater is a sealed quartz tube heater such as the halogen heater, the seal portion to which a lead wire is connected is formed by compressing the glass. When a temperature of the seal portion increases to a predetermined level (about 250° C., a gap is created due to the thermal expansion between the metal and glass and thus air may be introduced into the quartz tube through the gap, thereby reducing the service life of an inner filament of the quartz tube.

To solve the problem, a cover is provided with a plurality of holes to cool the seal portion.

However, although the forming of the holes on the cover may have an advantage of cooling the seal portion, thermal energy may leak through a gap created by a structure of the heater, a reflection plate or the like. Due to this, the temperature of the electric component room may increase, thereby deteriorating the food heating efficiency.

SUMMARY OF THE INVENTION

Accordingly, the present invention is directed to an electric oven, which substantially obviates one or more problems due to limitations and disadvantages of the related art.

An object of the present invention is to provide an electric oven having a heater cooling structure that can intensively cool only a seal portion of a halogen heater using the heat conduction.

Another object of the present invention is to provide an electric oven that has a heat discharge unit enclosing a seal portion and exposed to a cooling path of an electric component room, thereby cooling the seal portion and improving the food heating efficiency of the oven.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an electric oven including: a cavity having an electric component room; a light wave generating unit mounted on a top surface of the cavity, the light wave generating unit including a halogen heater emitting heat and light and a connector coupled to opposite ends of the halogen heater; and a heat discharge unit enclosing and cooling the connector.

In another aspect of the present invention, there is provided an electric oven including: a cavity; a partition plate dividing an upper portion of the cavity into an electric component room and an insulation layer; a halogen heater interposed between the partition plate and the cavity to emit heat and light; a connector connected to opposite ends of the halogen heater; and a heat discharge unit provided at a lower portion with a connector receiving portion for receiving the connector.

In still another aspect of the present invention, there is provided an electric oven including: a cavity having a cooling passage; a heat generating unit disposed on an upper portion of the cavity, the heat generating unit including a halogen heater generating light wave, a heater cover reflecting heat and light emitted from the halogen heater into the cavity, a connector connected to opposite ends of the halogen heater, and a supporter for supporting the connector; and a heat discharge unit conducting the heat generated from the connector, a portion of the heat discharge unit being exposed to the cooling passage.

According to the present invention, the temperature of the seal portion of the radiation heater can be stably maintained without forming additional fluid passage for directing air for cooling the seal portion.

In addition, since the heat-insulation material shields the circumference of the seal portion and an upper portion of the heat discharge unit is partly exposed to a cooling passage of an electric component room, heat loss caused by the leakage of the high temperature air can be prevented, thereby improving the food heating efficiency.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
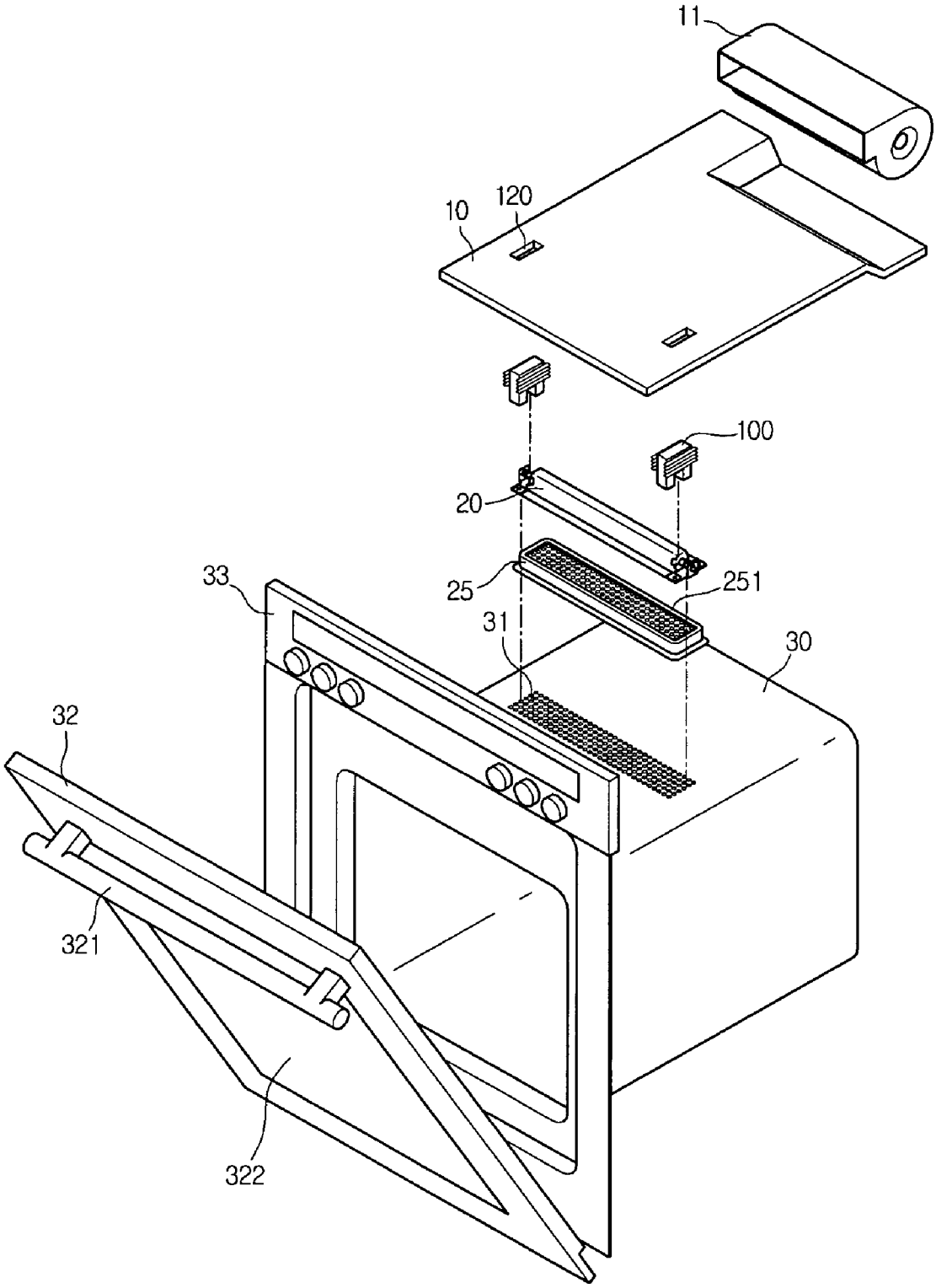
FIG. 1 is an exploded perspective view of an upper structure of a cavity of an electric oven according to an embodiment of the present invention.
Figure 2:
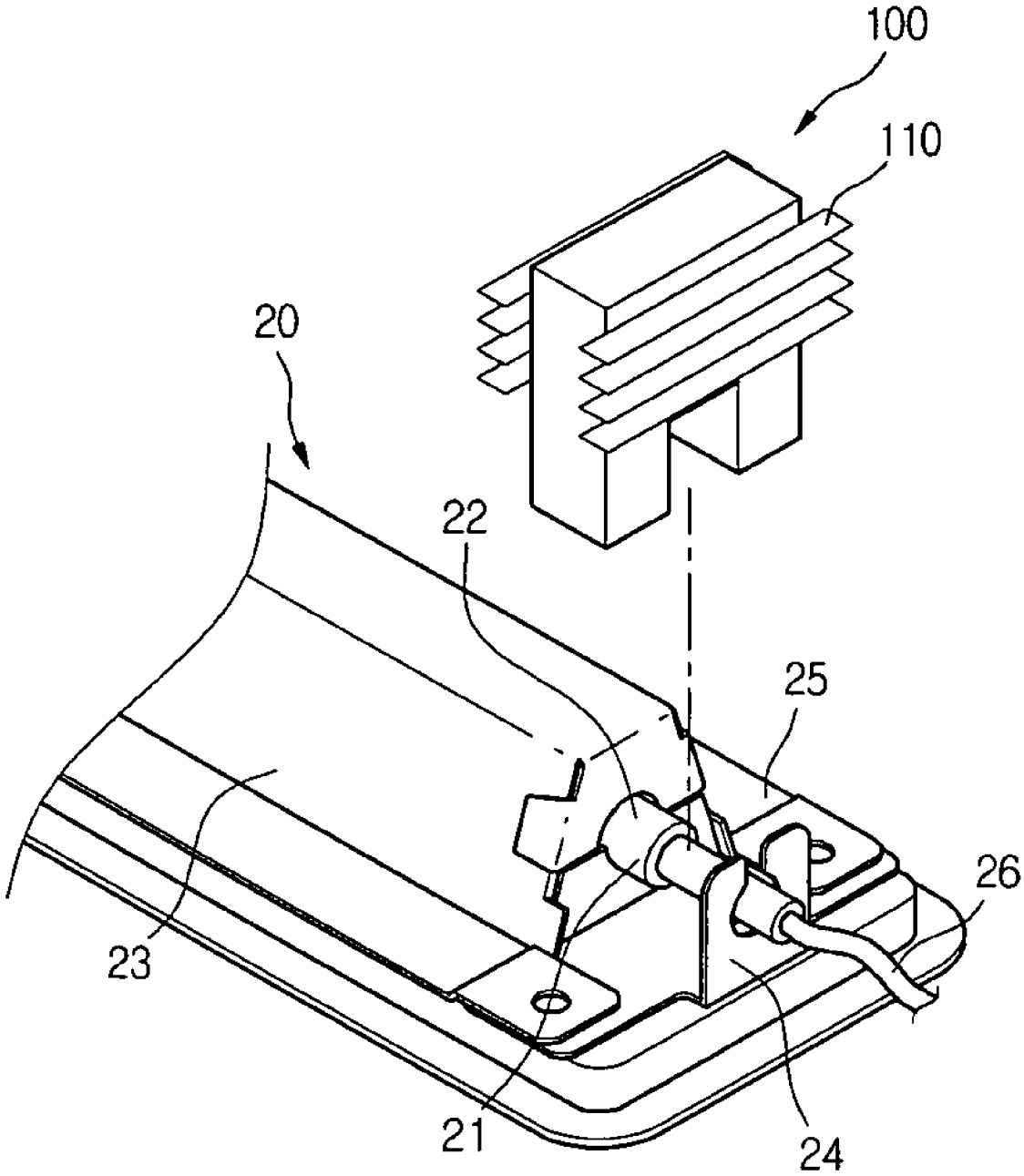
FIG. 2 is a partial perspective view of a halogen heater according to an embodiment of the present invention.

FIG. 1 is an exploded perspective view of an upper structure of a cavity of an electric oven according to an embodiment of the present invention and FIG. 2 is a partial perspective view of a halogen heater according to an embodiment of the present invention.

Referring to FIGS. 1 and 2, an electric oven according to an embodiment of the present invention includes a cavity 30 defining a cooking chamber, a light wave generating unit 20 mounted on an upper portion of the cavity 30, a partition plate 10 for covering the light wave generating unit 20, and a cooling fan 11 placed on the partition plate 10 and cooling an electric component room.

As a light source of the light wave generating unit, a halogen heater may be employed. The light wave generating unit 20 generates heat and far infrared rays. That is, when the electric oven employs the light wave generating unit 20, the food is equally cooked at its inner and outer portions by the heat containing the far infrared rays. That is, the light wave is distributed equally through the food, thereby equally cooking the food at the outer and core portions of the food. Furthermore, the light wave energy generated from the heater is intensively radiated to the food by a reflecting plate to improve the heating efficiency. In addition, by the stereo-heating of the halogen heater emitting the light wave, the temperature of the cavity increases up to 300° C. in five minutes. Therefore, the cooking speed of the electric oven of the present invention is three times the prior art electric oven. As the cooking speed increases, the disruption of nutrients and the vaporization of the moisture can be reduced, thereby effectively maintaining the inherent tastes of the food.

A front portion of the cavity 30 is opened and closed by a door 32. Mounted on a rear portion of the cavity 30 are a convection heater and a convection fan. Sheath heaters (not shown) are mounted on inner-upper and inner-lower portions of the cavity 30.

A door handle 321 is formed on a front-upper portion of the door 32. A transparent window 322 is provided on a central portion of the door 32 so that a user can identify the cooking state of the food. A control panel including a manipulation knob and the like is provided on the front-upper portion of the cavity 30.

Particularly, one the sheath heater is mounted on an inner-top of the cavity 30 and the light wave generating unit 20 having the halogen heater is mounted on an outer-top of the cavity. According to circumstance, only one of the sheath heater and the light wave generating unit may be mounted. Preferably, the light wave generating unit 20 is mounted on the outer-top of the cavity 30.

The cavity 30 is provided at the top with a plurality of through holes 31 through which the heat generated from the light wave generating unit 20 is directed into the cavity 30. The portion where the through holes 31 are formed is coated with enamel.

The light wave generating unit 20 includes a halogen heater 22, a heater cover 23 enclosing the halogen heater 22, a connector 21 connecting the halogen heater 22 to an electric wire 26, a supporter 24 for supporting the connector 21, a base 25 supporting the heater cover 23, the supporter 24 and the like, and a heat discharge unit 100 enclosing the connector 21. The heat discharge unit 100 fitted in guide holes 120 formed on the partition plate 10.

The halogen heater 22 is a light source generating visual and infrared rays and enables the high power as compared to its size. The halogen heater 22 may be formed in a variety of shapes as occasion demands.

The heater cover 23 serves to receive the halogen heater 22 and shield the top surface of the base. The heater cover 23 is screw-coupled to a top surface of the base 25. The heater cover 23 may be formed of stainless steel that is heat-resistant and corrosion resistant. The heater cover 23 extends in a longitudinal direction to receive the halogen heater 22.

A protruding step 251 having a predetermined width is formed on an edge of the base 25. The protruding step 251 allows the cavity 30 to be further spaced away from the halogen heater 22 so that the through holes 31 can be protected from the heat emitted from the halogen heater 22. Moreover, the protruding step 251 serves to attenuate the heat transfer from the cavity to the connector 21.

Meanwhile, the halogen heater 22 penetrates opposite ends of the heater cover 23. That is, opposite ends of the halogen heater 22 are exposed to both sides of the heater cover 23. The connector 21 is mounted on the exposed opposite ends of the halogen heater 22. That is, the halogen heater 22 is connected to an end of the connector 21 and the electric wire 26 is connected to the other end of the connector 21 to apply an electric current to the halogen heater 22. The connector 21 is supported by the supporter 24.

The connector 21 includes a glass body (not shown) and a metal layer (not shown) formed on the glass body. Therefore, when the temperature of the connector 21 increases to a predetermined level, a gap may be created between the metal layer and the glass body due to a thermal expansion difference between the metal layer and the glass body. When air is introduced through the gap, the service life of the filament of the halogen heater 22 is quickly reduced.

Therefore, in order to increase the service life of the light wave generating unit 20, the temperature of the connector must be maintained at a predetermined level less than 250° C. Therefore, in the present invention, the connector 21 is designed to be cooled by disposing the heat discharge unit 100 around the connector 21 and exposing the upper portion of the heat discharge unit 100 to the cooling passage of the electric component room 12. The exposing portion of the heat discharge unit 100 to the cooling passage of the electric component room 12 is provided with a plurality of heat discharge fins. The heat discharge unit 100 will now be described in more detail.

Figure 3:
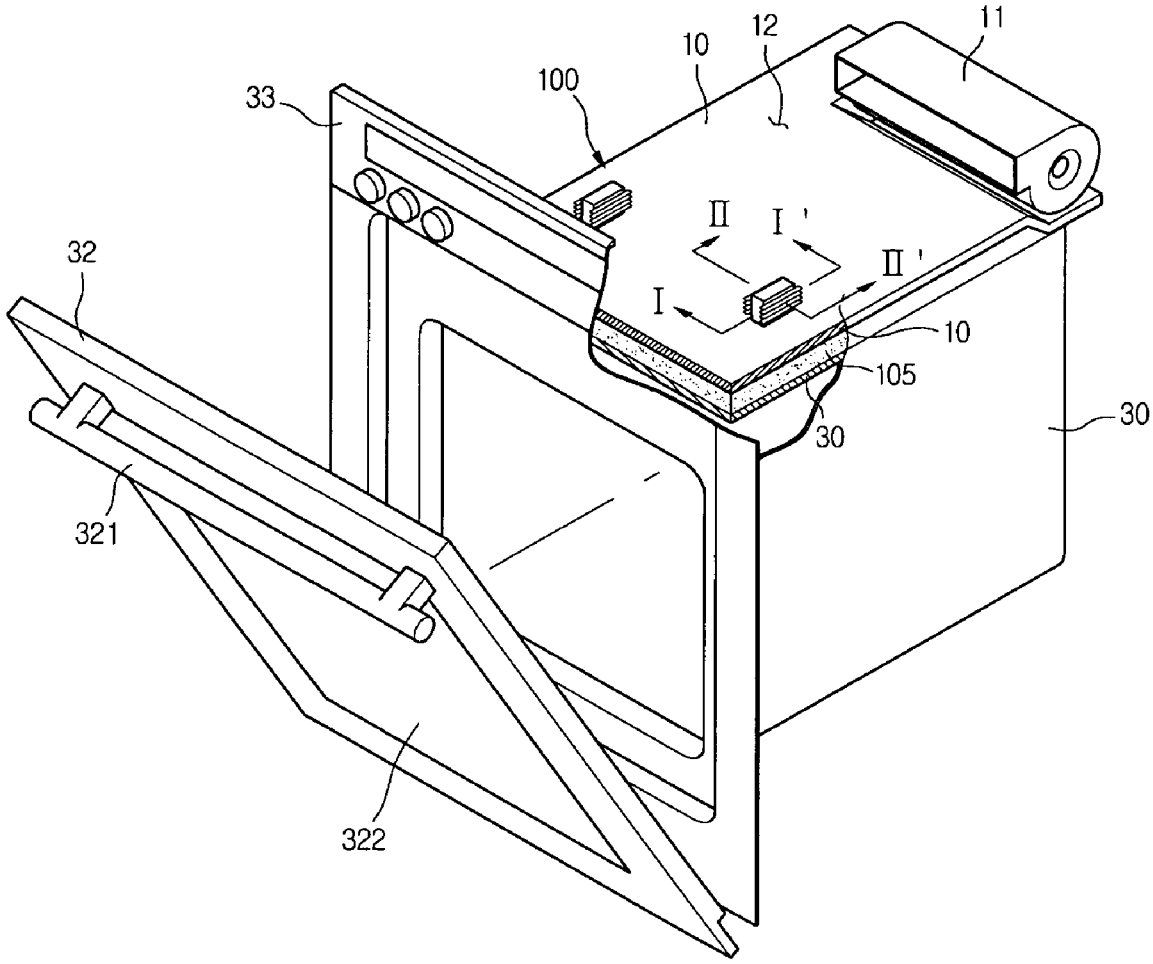
FIG. 3 is a partially broken perspective view of an upper portion of a cavity of an electric oven according to an embodiment of the present invention.
Figure 4:
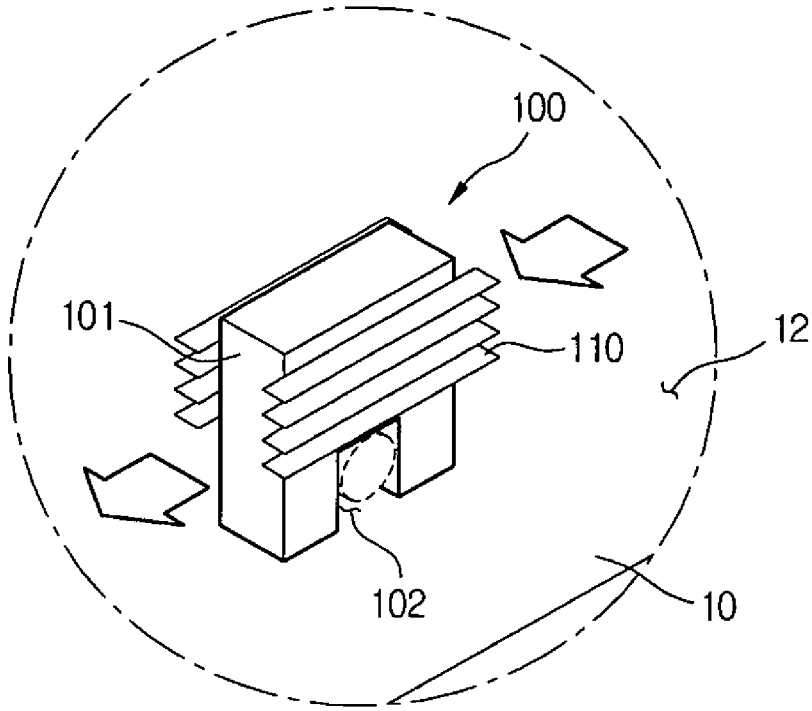
FIG. 4 is an enlarged view of an upper portion of a heat discharge unit according to an embodiment of the present invention.

FIG. 3 is a partially broken perspective view of an upper portion of the cavity of the electric oven according to an embodiment of the present invention and FIG. 4 is an enlarged view of the upper portion of the heat discharge unit according to an embodiment of the present invention.

Referring to FIGS. 3 and 4, the heat discharge unit 100 of the present invention includes a main body 101, a connector receiving portion 102 depressed on a bottom of the main body 101 to receive the connector 21, and a plurality of heat discharge fins 110 attached on the outer circumference of the main body 101.

The outer circumference of the connector 21 tightly contacts the inner circumference of the connector receiving portion 102 so that the heat generated from the connector 21 can be effectively transferred to the electric component room 12. An upper portion of the main body 101 is partly exposed to the cooling passage of the electric component room 12. The heat discharge fins 110 are fixed on the exposed portion of the main body 101 to the electric component room.

The heat discharge unit 100 may be formed of aluminum having high heat conductivity. In order to improve the cooling performance of the heat discharge unit 100, the heat discharge unit 100 and the connector 21 contacts each other as close as possible. At this point, it is preferable that the heat discharge unit 100 does not contact the cavity 30.

The heat discharge unit 100 is divided into upper and lower portions by the partition plate 10. That is, the connector receiving portion 102 is formed on the lower portion of the heat discharge unit 100 with reference to the partition plate 10 and the heat discharge fins 110 are formed on the upper portion of the heat discharge unit 100.

The light wave generating unit 20 is received between the partition plate 10 and the cavity 30 and an insulation member 105 is inserted between the partition plate 10 and the cavity 30 except for the portion where the light wave generating unit 20. As described with reference to FIG. 1, the partition plate 10 is provided with the guide holes 120. The upper portion of the heat discharge unit 100 is inserted in the guide holes 120 and exposed to the electric component room 12. That is, the heat discharge fins 110 fixed on the outer circumference of the main body 101 are exposed to the cooling passage of the electric component room 12. A rear end of the partition plate 10 is slightly curved downward so as to provide a space for receiving the cooling fan 11. The air generated by the cooling fan 11 flows along the cooling passage formed above the partition plate 10. The cooling passage will be described more in detail later.

Meanwhile, the insulation member 105 is closely coupled to the heat discharge unit 100 to intercept the heat transferred from the cavity 30 to the connector 21. That is, the insulation member 105 prevents the heat loss in the cavity 30.

In order to allow the heat exchange between the heat discharge fins 110 and the air flowing along the cooling passage to be effectively realized, the heat discharge fins 110 are formed on right and left surfaces of the heat discharge unit 100 and extend in a direction in parallel to a direction where the air flows along the cooling passage. A length of each heat discharge fin 110 may be longer than that of the heat discharge unit 100 so that the heat exchange can be quickly realized. The heat discharge fins 110 may be further formed on front and rear surfaces of the heat discharge unit 100. The number, length and forming location of the heat discharge fins 110 may vary according to a target cooling performance and a product where it is applied. The heat discharge fins 110 are preferably formed of aluminum having high thermal conductivity. As far as the cooling performance can be improved, the heat discharge fins 110 can by mounted on any locations of the upper portion of the heat discharge unit 100.

The heat discharge unit 100 is structured to be coupled to the heater cover, the supporter 24 and the like without forming additional holes. Since no hole is formed on the light wave generating unit 20 or the top surface of the cavity 30, the heat loss in the cavity can be prevented.

Figure 5:
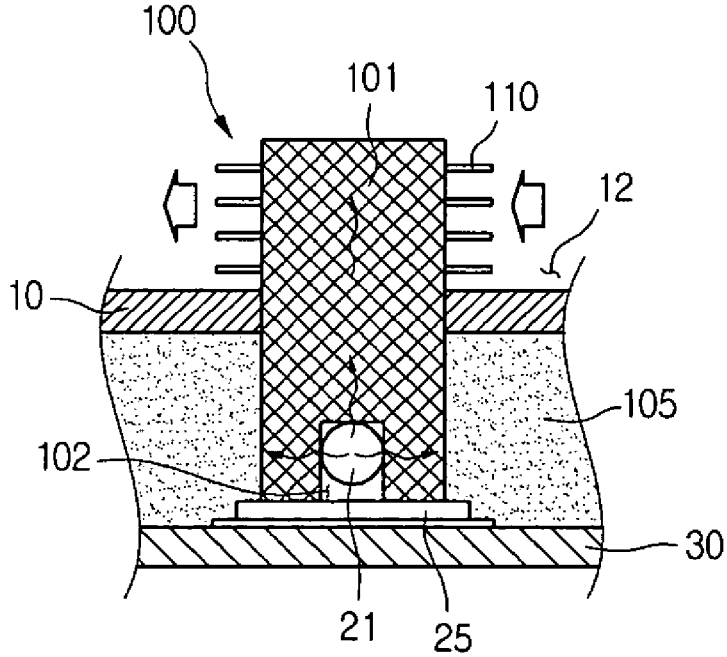
FIG. 5 is a sectional view taken along line I-I' of FIG. 3.
Figure 6:
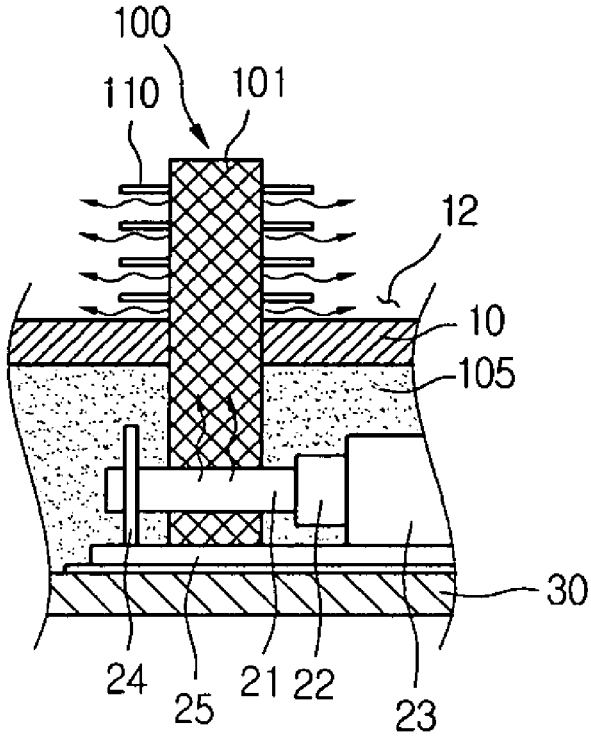
FIG. 6 is a sectional view taken along line II-II' of FIG. 3.

FIG. 5 is a sectional view taken along line I-I' of FIG. 3 and FIG. 6 is a sectional view taken along line II-II' of FIG. 3.

Referring to FIGS. 5 and 6, the heat generated from the connector 21 of the light wave generating unit 20 of the present invention is transferred to the heat discharge unit 100.

That is, the heat generated from the connector 21 is transferred to the inner circumference of the connector receiving portion 102 of the heat discharge unit 100 and is further transferred to the upper portion of the main body 101. The heat transferred to the upper portion of the main body 101 is transferred to the heat discharge fins 110. The heat transferred to the heat discharge fins 110 are absorbed by the air flowing along the cooling passage. Therefore, the temperature of the air flowing along the cooling passage increases as the air passes through the heat discharge unit 100, while the temperature of the connector 21 decreases. In addition, since the outer circumference of the connector 21 closely contacts the inner circumference of the connector receiving portion 102, the heat is transferred to the contact portion. At this point, the heat conductivity may vary according to the number and size of the heat discharge fins 110 formed on the outer circumference of the heat discharge unit 100.

Figure 7:
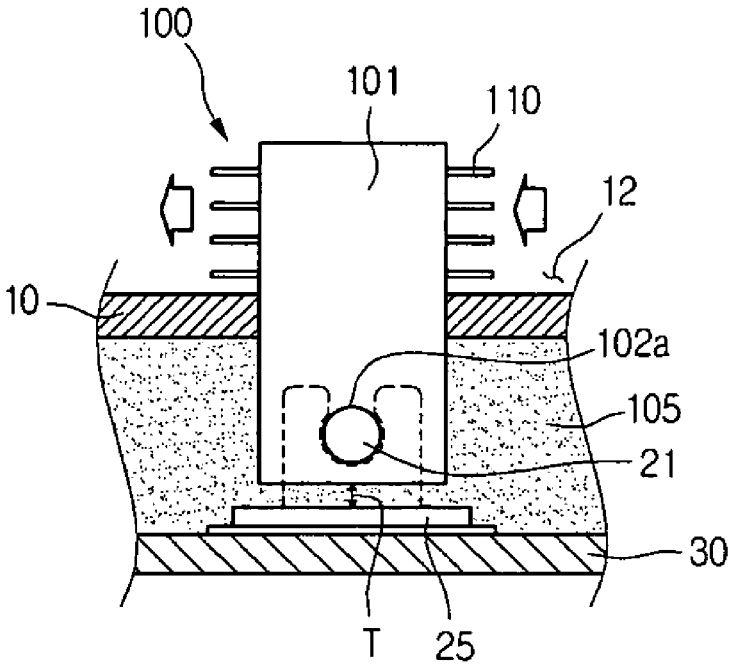
FIG. 7 is a sectional view of a coupling structure of a heat discharge unit according to another embodiment of the present invention.

FIG. 7 is a sectional view of a coupling structure of the heat discharge unit according to another embodiment of the present invention.

In an embodiment of FIG. 7, the connector receiving portion 102 of the heat discharge unit 100 may be formed by cutting away a portion of a lower end of the heat discharge unit 100. However, in this embodiment, the connector receiving portion 102 is formed by forming a circular hole 102*a* having a diameter identical to an outer diameter of the connector 21 on the heat discharge unit 100.

That is, the circular hole 102*a* is formed at a location elevated from a lower end of the heat discharge unit 100 and the connector 21 is inserted in the circular hole 102*a*. In this case, since the contacting surface between the connector 21 and the circular holes 102*a*, the heat exchange area between the connector 21 and the heat discharge unit 100 increases, thereby quickly cooling the connector 21. Moreover, the heat generated from the connector 21 is not transferred to the cavity 30 or the base 25 but directly transferred to the heat discharge unit 100. Therefore, a phenomenon where the base 25 or the supporter 24 is heated by the heat generated from the connector 21 can be prevented.

In order to prevent the heat transferred to the heat discharge unit 100 from being further transferred to the base 25 or the cavity 30, a bottom surface of the heat discharge unit 100 is spaced apart from a top surface of the supporter 24 by a predetermined distance T.

Figure 8:
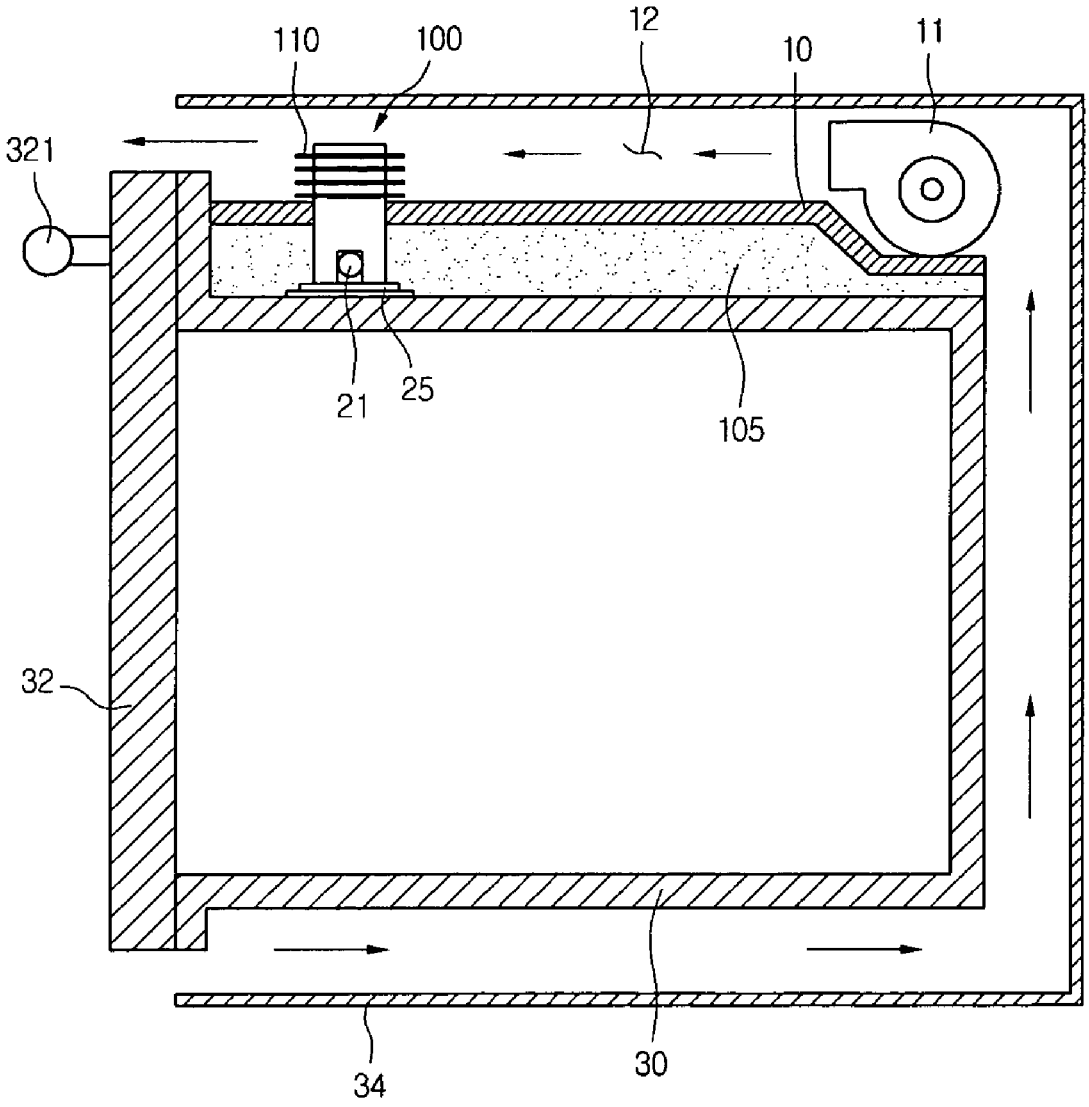
FIG. 8 is a side sectional view of a cooling structure for a heat discharge unit of an electric oven according to another embodiment of the present invention.

FIG. 8 is a side sectional view of a cooling structure of the heat discharge unit of the electric oven according to another embodiment of the present invention.

Referring to FIG. 8, the electric oven is provided at an outer side of the cavity 30 with the cooling passage. That is, a cabinet 34 is disposed around the cavity 30 and the cooling passage is defined between the cavity 30 and the cabinet 34.

The cooling fan 11 is disposed at a portion of the cooling passage to suck the room air. That is, the door 32 is provided at a lower portion with a room air intake hole. Therefore, when the cooling fan 11 operates, the room air is sucked through the room air intake hole. The room air sucked by the cooling fan 11 is discharged from a rear side of the electric component room to a front side of the electric component room 12. The door 32 is provided at an upper portion with a room air discharge hole. Therefore, the air flowing along the cooling passage is discharged through the room air discharge hole. The air passing through the cooling passage of the electric component cools a variety of electric components in the electric component room 12 as well as the exposed portion of the heat discharge unit.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An electric oven comprising:

a cavity having an electric component room;

a light wave generating unit mounted on a top surface of the cavity, the light wave generating unit including a halogen heater emitting heat and light and a connector coupled to opposite ends of the halogen heater;

a heat discharge unit enclosing and cooling the connector; and a partition plate dividing the heat discharge unit into upper and lower portions and allowing a portion of the heat discharge unit to be exposed to the electric component room.

2. The electric oven according to claim 1, further comprising an insulation member interposed between the partition plate and the cavity.

3. The electric oven according to claim 1, further comprising a plurality of heat discharge fins arranged on the outer circumference of the heat discharge unit, the heat discharge fins being formed above the partition plate.

4. The electric oven according to claim 1, wherein the heat discharge unit is provided at an outer circumference with a plurality of heat discharge fins.

5. The electric oven according to claim 1, wherein the cavity is provided at an outer side with a cooling passage along which cooling air to cool the heat discharge unit flows; and a cooling fan is mounted on a portion of the cooling passage to intake and exhaust room air.

6. The electric oven according to claim 5, wherein the heat discharge fins are exposed to the cooling passage.

7. The electric oven according to claim 1, wherein the light wave generating unit further includes a heater cover that reflects the heat generated from the halogen heat into the cavity and a base interposed between the heater cover and the cavity.

8. The electric oven according to claim 1, wherein the heat discharge unit is formed of aluminum having predetermined thermal conductivity.

9. The electric oven according to claim 1, wherein the connector is supported by a supporter and spaced apart from a top surface of the cavity, and an outer circumference of the connector contacts the heat discharge unit to transfer the heat generated from the connector to the heat discharge unit.

10. An electric oven comprising:

a cavity;

a halogen heater mounted on a top surface of the cavity, the halogen heater generating heat and light;

a connector connected to opposite ends of the halogen heater; and a heat discharge unit provided at a lower portion with a connector receiving portion into which a connector is insertable, the connector receiving portion formed as a hole.

11. The electric oven according to claim 10, wherein the connector receiving portion has a diameter identical to an outer diameter of the connector.

12. The electric oven according to claim 10, further comprising a supporter that supports the connector.

13. The electric oven according to claim 12, wherein a lower end of the heat discharge unit is spaced apart from a bottom of the supporter by a predetermined height.

14. The electric oven according to claim 10, wherein the connector receiving portion at least partly contacts an outer circumference of the connector.

15. The electric oven according to claim 10, further comprising a plurality of heat discharge fins formed on an outer circumference of the heat discharging unit.

16. The electric oven according to claim 15, wherein a length of the heat discharge fin is equal to or longer than that of the heat discharge unit.

* * * * *